US009925408B1

(12) United States Patent
Murdock

(10) Patent No.: US 9,925,408 B1
(45) Date of Patent: Mar. 27, 2018

(54) MODULAR EXERCISE DEVICE

(71) Applicant: Fit2Train LLC, New York, NY (US)

(72) Inventor: Amanda Murdock, New York, NY (US)

(73) Assignee: Fit2Train LLC, New York, NY (US)

( * ) Notice: Subject to any disclaimer, the term of this patent is extended or adjusted under 35 U.S.C. 154(b) by 198 days.

(21) Appl. No.: 15/042,708

(22) Filed: Feb. 12, 2016

(51) Int. Cl.

| | |
|---|---|
| ***A63B 21/06*** | (2006.01) |
| ***A63B 21/075*** | (2006.01) |
| ***A63B 21/00*** | (2006.01) |
| ***A63B 23/12*** | (2006.01) |
| *A63B 23/00* | (2006.01) |

(52) U.S. Cl.
CPC ..... *A63B 21/075* (2013.01); *A63B 21/0004* (2013.01); *A63B 21/00047* (2013.01); *A63B 21/00065* (2013.01); *A63B 21/4035* (2015.10); *A63B 21/4043* (2015.10); *A63B 23/12* (2013.01); *A63B 2023/006* (2013.01)

(58) Field of Classification Search
CPC ... A63B 21/06; A63B 21/0605; A63B 21/065; A63B 21/072; A63B 21/0724; A63B 21/0726; A63B 21/075; A63B 21/00065; A63B 21/4035; A63B 21/4043; A63B 23/12; B65D 85/00; B65D 25/2823; B65D 25/2867; B65D 25/2891; B65D 25/30
USPC ..... 206/315.1; 220/770, 771
See application file for complete search history.

(56) References Cited

U.S. PATENT DOCUMENTS

| | | | | |
|---|---|---|---|---|
| 2,702,626 | A * | 2/1955 | Nuttle | B25H 3/02 220/768 |
| 4,575,074 | A * | 3/1986 | Damratoski | A63B 21/0602 482/93 |
| 5,102,124 | A * | 4/1992 | Diodati | A63B 21/0605 482/106 |
| 6,312,364 | B1 * | 11/2001 | Selsam | A63B 21/06 206/501 |
| 6,730,004 | B2 * | 5/2004 | Selsam | A63B 21/06 206/501 |
| 6,872,173 | B2 * | 3/2005 | Krull | A63B 21/0728 482/107 |
| 7,156,791 | B2 * | 1/2007 | Edwards | A63B 21/0004 446/120 |
| 2007/0287608 | A1 * | 12/2007 | Hallar | A63B 21/06 482/104 |
| 2008/0023355 | A1 * | 1/2008 | Reynolds | A63B 71/0036 206/315.1 |
| 2009/0023563 | A1 * | 1/2009 | Liang | A63B 71/0036 482/106 |
| 2010/0300906 | A1 * | 12/2010 | Moore | A45C 13/02 206/315.1 |

(Continued)

*Primary Examiner* — Gregory Winter
(74) *Attorney, Agent, or Firm* — Zeller IP Group, PLLC; Kyle M. Zeller

(57) ABSTRACT

An adjustable-weight exercise device includes a body having a through-hole; a handle centrally located in the body and disposed within the through-hole; and at least one internal compartment having a number of insertion slots therein, each adapted to receive a weight. The device may include a covering member disposed over each of the internal compartments, each fastened to the body. The adjustable-weight exercise device may be employed in a variety of physical activities to seamlessly move from one desired position or movement to the next without inconvenience or interruption.

19 Claims, 5 Drawing Sheets

(56) References Cited

U.S. PATENT DOCUMENTS

| | | | | |
|---|---|---|---|---|
| 2014/0141944 | A1* | 5/2014 | Johnson et al. ..... | A63B 21/072<br>482/93 |
| 2015/0001110 | A1* | 1/2015 | Chen ..... | A63B 71/0036<br>206/315.1 |
| 2016/0263421 | A1* | 9/2016 | Gvoich ..... | A63B 21/0605 |

* cited by examiner

MODULAR EXERCISE DEVICE

FIELD OF THE INVENTION

The present invention relates generally to athletic equipment and more particularly, to an adjustable-weight, handheld exercise device for use in a variety of physical activities, such as yoga, stretching, pushups, and assorted dumbbell exercises.

BACKGROUND

Exercise devices used to aid athletes are well known in the art. For example, foam or hardwood blocks are currently used while performing certain yoga poses or during stretching. These blocks provide numerous benefits including: shortening the distance between the ground and the body for difficult poses, modifying poses for practitioners requiring increased flexibility, aiding the practitioner to hold a pose more comfortably for longer periods of time, reducing the chance of injury due to muscle strain and fatigue, and/or providing support by allowing the body to maintain proper alignment.

U.S. Pat. No. 7,156,791 to Edwards discloses an exemplary yoga grip block having one or more block sections and a grip section that provides support and comfort in the practice of yoga exercises. Similarly, U.S. Patent Application Publication 2013/0274078 to Andrews discloses a wrist saver block that decreases the amount of stress and strain felt by a user's wrist joint by providing a handle that is gripped when performing upper-body weight-bearing exercises. Both the yoga grip block and the wrist saver block are said to reduce wrist-strain of yoga practitioners. However, they do not allow the user to customize a workout to incorporate the benefits of another sporting activity, such as weight training.

While lightweight devices, like yoga blocks, are well suited for assisting specific physical activities (e.g., certain stretches or yoga positions), they are ill-suited for activities that require the use of handheld weights, such as hybrid workouts. Such workouts are growing in popularity and provide various health benefits for the participant. For example, combining weight training with yoga allows the participant to effectively tone and strengthen muscles simultaneously in a way that cannot be obtained from practicing weight training or yoga alone.

Dumbbells are often the first choice of a yoga practitioner who wishes to add weight-lifting to a yoga routine, or otherwise increase the resistance of certain yoga exercises. Dumbbells are used for providing resistance training in a wide variety of exercises such as bicep curls, weighted squats, shoulder presses, triceps extensions, and the like. However, due to the number of exercises that may be performed with dumbbells, users often need many different dumbbells, each with different weights, to perform an exercise routine. Moreover, a yoga practitioner will still require a separate yoga block for certain exercises.

U.S. Patent Application Publication 2009/0023563 to Liang discloses a body tone exercise brick having a recessed portion that houses weights and a handle. The handle can be placed within the recessed portion of the brick to decrease the amount of stress and strain felt by user's wrist joint when performing upper-body weight-bearing exercises, and can also be attached to the weights to create a free weight dumbbell that can be used for weight training exercises. However, the body tone exercise brick requires assembly of the weights with the handle to be used as a dumbbell and further requires disassembly to use the handle within the brick to reduce wrist stress and strain. Assembling and disassembling the components of the body tone exercise brick causes frequent interruption to a workout and does not allow a user to flow from one position to the next efficiently or effectively.

In light of the aforementioned and other limitations and failings of known exercise devices, there is a clear need for an exercise device that combines the benefits of handheld weights with the posture and stretching-assistance benefits of a yoga-type block. It would be beneficial if the weight of such a device was easily adjustable by a user.

BRIEF SUMMARY OF THE INVENTION

In accordance with the present invention, handheld, adjustable-weight exercise devices are described herein that overcomes each of the above described disadvantages. The inventive exercise devices can be employed for a variety physical activities, such as yoga, pushups, and assorted handheld dumbbell exercises. The weight of the exercise device may be adjustable such that any number of weights may be added or removed from one or more internal compartments of the device that are easily accessible by a user.

To achieve the foregoing objects, and in accordance with the invention as embodied and broadly described herein, embodiments of the invention feature an adjustable weight exercise device that consists of a block-type body having a centrally positioned through-hole, a handle centrally located within the body and disposed within the through hole; at least one internal compartment adapted to removably secure one or more weights therein; and a covering member adapted to be disposed over the at least one internal compartment, e.g., via a fastener or the like. The device may include an internal support structure that supports the weight of the device (including any inserted weights) and allows the device to maintain its shape when in use or at rest. The support structure may include a number of vertical and/or horizontal brackets adapted to secure one or more weights, and to prevent the one or more weights from substantial vertical and/or horizontal movement during use of the device.

In one aspect of the invention, an adjustable-weight, handheld exercise device is disclosed to include a body having a top wall connected to a substantially parallel bottom wall via a peripheral wall. The peripheral wall may include substantially parallel front and back side walls; a right side wall; and a left side wall that is substantially parallel to the right side wall. The left side wall may include an aperture extending from an outer surface to an inner surface thereof. The device may include a through-hole extending from the top wall to the bottom wall. The device may also include a first internal compartment extending within an internal volume of the body, from the inner surface of the left side wall. The compartment may be adapted to removably receive one or more weights therein. Moreover, the device may include a handle that is disposed within the central through-hole and adapted to be gripped by the user.

In another aspect of the invention, an adjustable-weight, handheld exercise device is disclosed. The device may include a top wall connected to a substantially parallel bottom wall via a peripheral wall. The peripheral wall may include, for example, substantially parallel front and back side walls; a right side wall having an aperture extending from an outer surface to an inner surface thereof; and a left side wall substantially parallel to the right side wall and including an aperture extending from an outer surface to an inner surface thereof. The device may include a through-hole extending from the top wall to the bottom wall. The device may also include an inner support structure that may extend around the central through-hole, from an inner surface of the top wall to an inner surface of the bottom wall. A handle may also be disposed within the central through-hole and fixed to the inner support structure. The device may include a first internal compartment extending within an internal volume of the body from the inner surface of the left side wall to the inner support structure. The first compartment may include a number of insertion slots, each adapted to removably receive a weight therein. The device may also include a second internal compartment extending within an internal volume of the body from the inner surface of the right side wall to the inner support structure. The second internal compartment may include a number of insertion slots, each adapted to removably receive a weight therein. The device may include a left side covering member fastened to the body that is adapted to cover the left side wall aperture when placed in a closed state, and to allow access to the aperture when placed in an open state. Finally, the device may include a right side covering member fastened to the body that is adapted to cover the right side wall aperture when placed in a closed state, and to allow access to the aperture when placed in an open state.

These and other aspects of the invention may be more clearly understood by reference to the following detailed description of the invention and the appended claims.

BRIEF DESCRIPTION OF THE SEVERAL VIEWS OF THE DRAWINGS

Preferred embodiments of the present invention are illustrated by way of example and not limited to the following figures. It is to be understood that in some instances various aspects of the invention may be shown exaggerated or enlarged to facilitate an understanding of the invention.

DETAILED DESCRIPTION OF THE INVENTION

Figure 1:
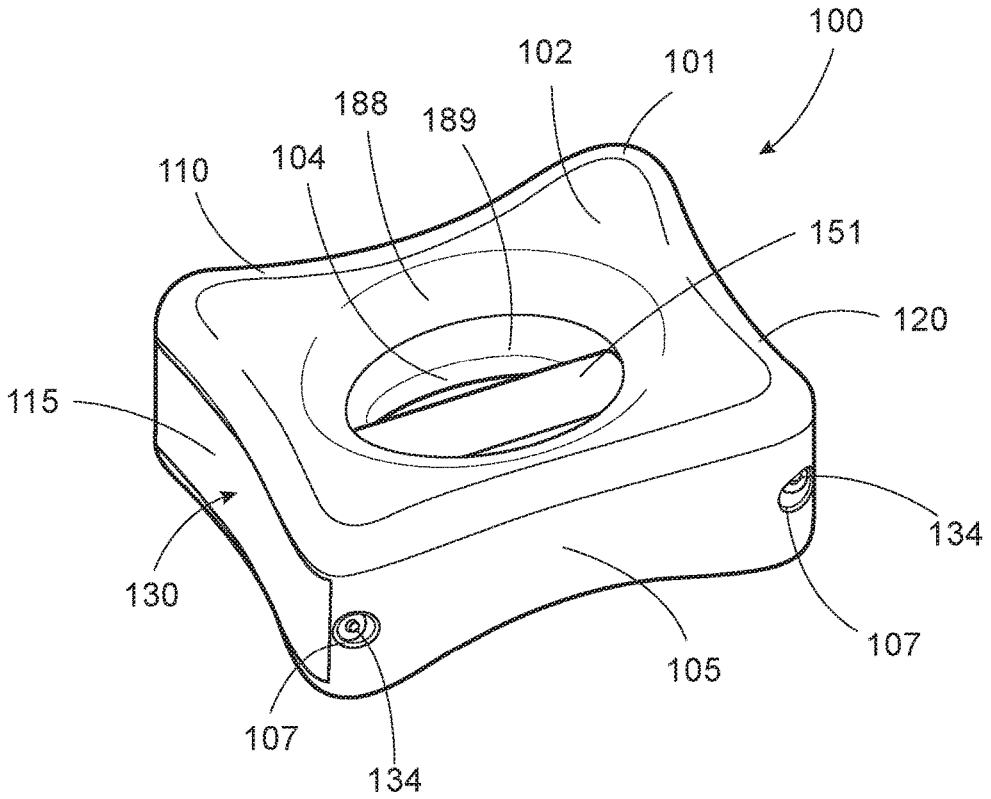
FIG. 1 is a top perspective view of an adjustable-weight, handheld exercise device 100 according to an exemplary embodiment of the invention.
Figure 2:
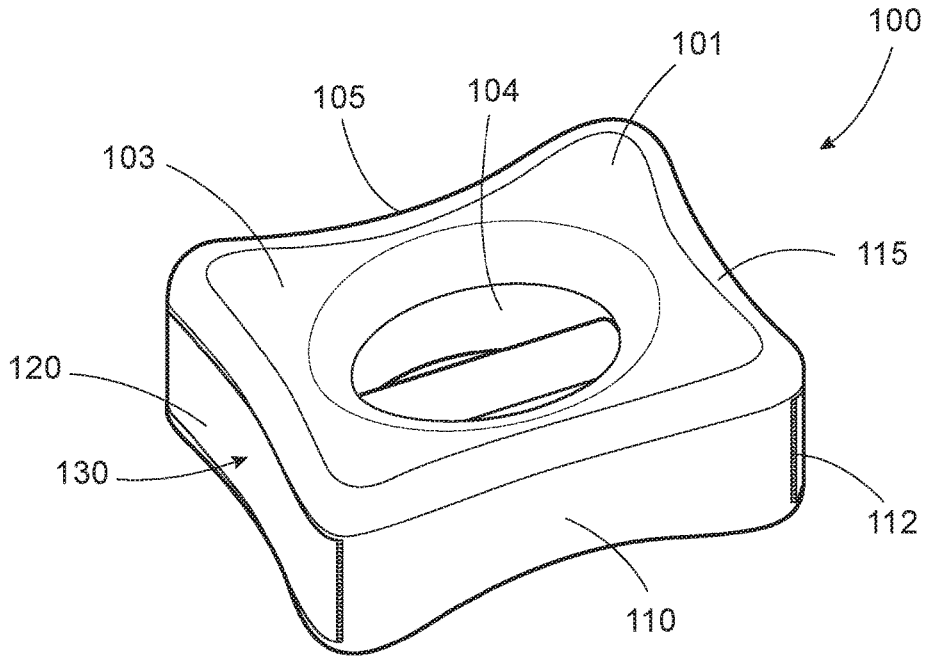
FIG. 2 is a bottom perspective view of the exercise device 100 shown in FIG. 1.

Various embodiments and aspects of the invention will be described with reference to details discussed below, and the accompanying drawings will illustrate the various embodiments. The following description and drawings are illustrative of the invention and are not to be construed as limiting the invention. Numerous specific details are described to provide a thorough understanding of various embodiments of the present invention. However, in certain instances, well-known or conventional details are not described in order to provide a concise discussion of embodiments of the present invention.

The inventive exercise devices described herein are adapted to allow a user to easily adjust the total weight of the device such that it may be used for a variety of physical activities, including yoga, pushups, and assorted handheld dumbbell exercises. To that end, the exercise devices may comprise at least one, but preferably two, internal compartments adapted to have a number of weights removably housed therein. Each internal compartment may be accessed by a user by opening a covering member, such as a door. One or more weights may then be inserted into an available insertion slot within the chamber, and the covering member may be closed. The weights are securely retained by the device during use, without substantial horizontal or vertical movement, but are easily accessed for insertion and/or removal by a user. A user may employ a single exercise device or a pair of exercise devices, depending on an exercise being performed.

Referring to FIGS. 1-3C, multiple views of an adjustable-weight, handheld exercise device 100 according to an exemplary embodiment of the invention are illustrated. As shown, the device comprises a body 101 having a centrally positioned through-hole (a center opening) 104 and a handle 151 centrally located within the body and disposed within the through-hole.

The exercise device body 101 comprises a generally cubic or rectangular cuboid-type shape, with a parallel top face 102 and bottom face 103 connected by a peripheral wall defined by a left side wall 115, a right side wall 120, a front side wall 105 and a rear or back side wall 110. The device may comprises two parallel longer sides (i.e., the front side wall 105 and back side wall 110) extending the length of the top and bottom faces, and two parallel, shorter sides (i.e., the left side wall 115 and right side wall 120) extending the width of the top and bottom faces, perpendicular to the longer sides.

Each of the top face 102 and bottom face 103 may comprise substantially straight sides or, in a more preferred embodiment, may have concave sides that curve slightly inward from the corners of the respective face toward a center thereof. In certain embodiments, the top face and/or bottom face (102, 103) can be substantially flat or may be sloped inward from their respective outer edges toward the center opening 104.

It will be appreciated that the exercise device includes a top face 102 and a bottom face 103 that, except where otherwise described, are generally identical. Thus, when reference is made to one or more parts on the top face of the exercise device, it is to be understood that corresponding or similar part(s) may be disposed on the bottom side of the device.

In certain embodiments, each of the side walls (105, 110, 115, 120) can be substantially flat or may be slightly concave, with an inward slope from their respective outer edges to a midpoint thereof.

Exemplary exercise devices 100 may comprise a length of from about 8 inches to about 12 inches, for example about 10 inches. The width of the device is typically less than or equal to the length, and may range from about 6 inches to about 10 inches, for example about 8 inches. The height of the device is typically shorter than both the width and length thereof, because a short height and broad base provides a secure foundation against tipping. Accordingly, the height may range from about 2 inches to about 6 inches, for example about 4 inches. This configuration allows for the device to support a user's body weight, while still being easily handled and moved about by the user during exercise. It also allows for stacking of multiple devices in a horizontal configuration, if necessary, to support a yoga position or to make a pushup more difficult.

It will be appreciated that, although the exercise device body 101 is illustrated as having a generally rectangular-type shape, other shapes may be employed without departing from the spirit and scope of the present invention. In particular a device having an oval, square, or triangular-shaped top and bottom face connected by a peripheral side wall could be utilized in a similar fashion.

As shown, the device body 101 comprises a hollow through-hole or center opening 104 extending from the top face 102 of the device to the bottom face 103 thereof. The center opening 104 is at least large enough to accommodate a hand of a user therein.

The center opening 104 may comprise a circular shape or, as shown, an oval shape with a length that is larger than its width. Such configuration may allow for a maximum length of handle 151 to be available for gripping by a user. For example, the center opening 104 may have a length of between about 6 inches and about 9 inches, and a width of between about 5 inches and about 7 inches. In one exemplary embodiment, the center opening may be about 8 inches in length and about and about 6 inches wide.

The center opening 104 may be formed within the device body 101 such that it includes a top and/or bottom inwardly-sloping face 188 and a substantially flat inner wall 189 located between the top and bottom sloped surfaces. The sloped top and bottom faces 188 may facilitate the insertion of a user's hand into the center opening 104 so that they can grab a handle 151 disposed therein. And the flat inner wall portion 189 may allow the handle 151 to be more securely fastened to the device in a substantially horizontal configuration.

In other embodiments, the center opening 104 may comprise only substantially flat inner walls 189, without a top or bottom slope, such as when the top 102 and/or bottom face 103 of the device are substantially flat. In yet another embodiment, the inner wall of the center opening may comprise protrusions or a rough textured surface such that the inner wall 189 may be more easily gripped by a user (not shown).

It will be appreciated that, although the center opening 104 is illustrated as having an oval shape, other shapes may be utilized without departing from the spirit and scope of the present invention. In particular the center opening may be circular, square, rectangular, triangular or any other shape and still function in a similar fashion.

The exercise device body 101 may be made of any number of weight-bearing, shape-sustaining materials. In one preferred embodiment, the body 101 comprises a closed-cell EVA foam or similar lightweight, dense, and supportive materials. The body may comprise one or more materials selected from the of the group consisting of: hardwood, laminate wood, metals (e.g., aluminum, titanium, or stainless steel), composites, rubber, foams and molded plastic material.

Although not shown, the exercise device 100 may comprise a frictional material and/or coating on any of the top face 102, bottom face 103 or side walls (105, 110, 115, 120) thereof. Such frictional materials and/or coatings can act to stabilize the device against movement from lateral forces encountered during athletic activities. Any high-friction material and/or coating may be employed, such as but not limited to natural rubber, silicon polymers, neoprene foam, an additional injection molding or other materials known by those in the art. Useful materials and/or coatings may also dampen vibration and/or noise produced while performing athletic activities, while also protecting floor surfaces such as foam mats commonly used in yoga practice.

As shown, the device comprises a manually grippable handle 151 extending through the center opening 104 from a left side of the inner wall 189 of the center opening to a right side thereof. The handle 151 can extend along an axis from a central point on the left side of the inner wall and a central point on the right side of the inner wall of the center opening (not shown). In other words, the handle 151 may be centered within the depth of the opening (and the device) along a central horizontal axis of the device. In alternative embodiments, the handle may be positioned in other locations within the center opening 104, for example at an offset vertical or horizontal axis. In another, less preferred embodiment, the handle may extend along the width of the device (rather than across the length thereof) from a front side of the inner wall of the center opening to a rear side thereof.

The handle 151 may comprise a hollow or solid cylindrical structure that is generally symmetrical throughout its length (i.e., it has a generally constant circumference). The handle is adapted to be gripped by the fingers of a user and accordingly may have a length of about 6 inches to about 9 inches, for example, about 8 inches. The handle may comprise a circumference of about 3 inches to about 6 inches, for example, about 4 inches.

The handle 151 may comprise one or more of the following materials: foams, plastic materials, metals (e.g., aluminum, titanium, or stainless steel), composites, hardwood, laminate wood, and/or rubber. The handle is adapted to support the weight of the device and to allow a user to pick up and move the device without rotation of the handle with respect to the device body.

An external material or coating may be applied to the outer surface of the handle 151 to enhance comfort and/or grip during use. Exemplary materials and coatings include, but are not limited to fabric, leather, rubber, synthetic polymers, synthetic foam or other appropriate materials known in the art.

As discussed in detail below, the handle 151 may be integrally formed with, or mounted to, an internal support structure seated within the device body. Accordingly, the handle may comprise a metallic internal structure enclosed in an outer foam layer.

In another embodiment, the handle may include a grip portion such as one or more longitudinal or latitudinal grooves (not shown) on the surface thereof. Such grooves may provide means to prevent slippage by a hand gripped thereon. In yet another embodiment, the handle 151 comprises a substantially smooth outer surface throughout its length.

Internal Compartment(s)

The exercise device comprises at least one, but preferably two, internal compartments located on opposite sides of the device. The compartments are adapted to have a number of weights removably, but securely, housed therein. To that end, the compartments may comprise a number of insertion slots, which act to retain any inserted weights during use, without substantial horizontal or vertical movement, but allow for easy access of the weights for insertion and/or removal by a user.

As may best be seen in FIGS. 1 and 3A-3C, the left side wall 115 of the exercise device 100 may comprise a covering member 130 such as a door or the like. The covering member 130 is adapted to be disposed over an internal compartment 160 such that it may be opened and closed by a user, and such that it will remain securely closed during use of the device.

Figure 3A:
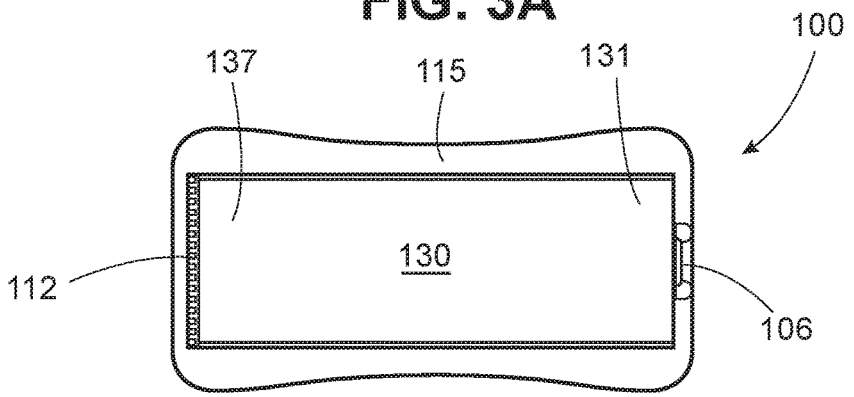
FIG. 3A is a left side 115 elevational view of the exercise device 100 shown in FIGS. 1 and 2.
Figure 3B:
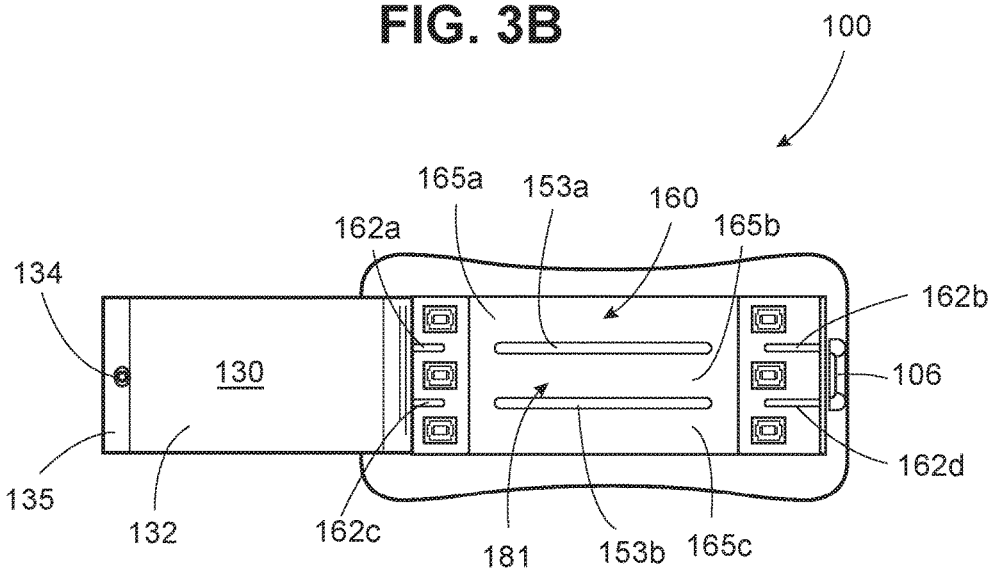
FIG. 3B is a left side elevational view of the device as shown in FIG. 3A, illustrating a covering member 130 in an open position to expose an internal compartment 160 adapted to removably secure a number of weights therein.
Figure 3C:
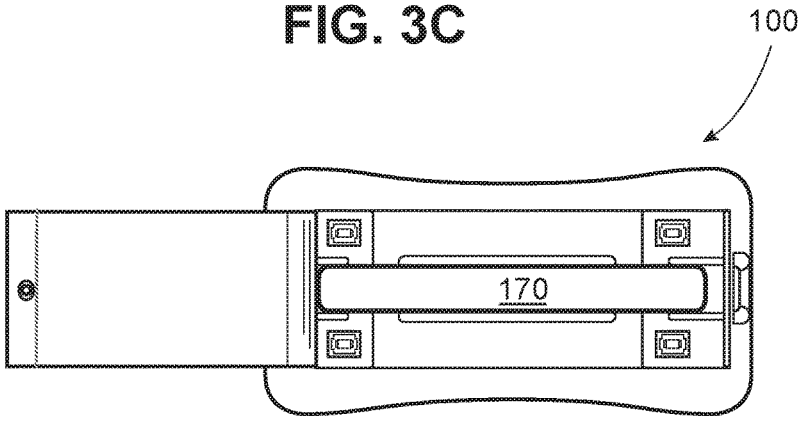
FIG. 3C is a left side elevational view of the device as shown in FIGS. 3A and 3B, illustrating a weight 170 seated in one of a number of available insertion slots present within the internal compartment.

As shown, the covering member 130 may comprise a door that is transitionable between the closed state shown in FIG. 3A and the open state as shown in FIGS. 3B and 3C. The open state shows the door 130 extending substantially laterally away from the left side wall 115 of the device body 101 toward the back side wall 110 thereof. The closed state shows the door 130 nested within the left side wall 115 such that the outer surface of the door 131 is substantially flush with the wall.

A first side of the door 137 may be rotatably connected to the device body 101 via a hinge 112 or the like. The hinge 112 may be positioned proximate an edge defined by the left side wall 115 and back side wall 110 of the device body (See FIG. 2). The hinge 112 is optionally formed as a door-hinge type structure, as a flexible piece of material, or as any other hinge or other appropriate structure about which the door is able to be rotated relative to the device body.

A second side of the door 135 may be detachably connected to the device body 101 via complementary fastening means present on the door 134 and the device body 101. As shown, the fastening means may comprise a spring-loaded device 134, such as a spring or ball plunger, that is at least partially disposed within an inner chamber of the door, located about the right-most edge of the door 135. The spring or ball plunger 134 comprises a spring having a first end seated against the inner surface of the door's inner chamber. A second end of the spring is in contact with a ball (i.e., a protrusion having a tapered end surface), which causes the ball to be generally biased to extend from within the door's inner chamber. The diameter of the inner chamber is slightly less than the diameter of the ball, such that the ball is retained within the chamber, but partially projects outward therefrom. When the door is closed, the ball strikes an edge of the device body and is pushed inward into the door's inner chamber, allowing the door to be completely closed. Upon reaching, for example, an aperture 106 in the inner surface of the device body proximate an edge defined by the left side wall 115 and the front wall 105, the ball extends at least partially through the aperture 106 from the inner surface to an outer surface of the front side wall 105. The door 130 will thus remain in a closed position until an inward force is applied to the ball so that it retracts into the inner chamber of the door.

The aperture 106 for receiving the ball plunger 134 may be located within an indentation 107 formed in a side wall surface of the exercise device, such as the front side wall 105. The indentation 107 is adapted to prevent accidental engagement of the ball plunger 134, such as when the exercise device 100 is dropped or placed on its front side wall 105 or the edge connecting the front side wall and left side wall 115. In certain embodiments, the indentation 107 may be sized to allow a user to comfortably place a finger or thumb within the indentation to engage the ball plunger 134, freeing it from the aperture 106 and thus allowing the door 130 to rotate on its hinge 112 to an open state.

Referring to FIG. 3B, the exercise device is shown in an open and empty state, with the door 130 rotated about the hinge 112 and with the fastening means of the door 134 disengaged from the fastening means of the device body 101. The exercise device is shown to comprise an empty first internal compartment 160 extending inward from the left side wall 115 toward an interior housing 181 having an internal support structure enclosed therein, located within the device body (discussed in detail below). The first internal compartment 160 is generally defined by the inner surfaces of the left 115, back 110 and front 105 side walls and a leftmost surface of an interior housing 181.

The compartment 160 may include a predetermined number of insertion slots into which weights may be removably inserted. There are three insertion slots shown in the illustrated embodiment: a top insertion slot 165*a*, a middle insertion slot 165*b* and a bottom insertion slot 165*c*. Each of the insertion slots comprises: a rear side defined by the inner surface of the back side wall 110 of the exercise device; a front side defined by the inner surface of the front side wall 105 of the exercise device; a left side defined by the inner surface of the left side wall 115 of the exercise device (including the inner surface of the door 132 when the door is closed); and a right side extending along the interior housing 181, from the inner surface of the front side wall 105 to the inner surface of the rear side wall 110.

The slots are separated vertically by a horizontal upper shelf and a horizontal lower shelf. The upper shelf may comprise a top front side wall ledge 162*a* that runs along the front side wall and extends horizontally into the inner compartment; a top back side wall ledge 162*b* that runs along the back side wall and extends horizontally into the inner compartment; and a top horizontal bracket 153*a* that extends horizontally into the inner compartment from the interior housing 181.

The lower shelf comprises a bottom front side wall ledge 162*c* that runs along the front side wall and extends horizontally into the inner compartment; a bottom back side wall ledge 162*d* that runs along the back side wall and extends horizontally into the inner compartment; and a bottom horizontal bracket 153*b* that extends horizontally into the inner compartment 160 from the vertical internal support structure 180.

For clarity, the top front side wall ledge 162*a* and top back side wall ledge 162*b* are located on the substantially same horizontal axis, and are separated by a vertical distance from the bottom front side wall ledge 162*c* and bottom back side wall ledge 162*d*, which are both located on the substantially same, lower horizontal axis. The side wall ledges may extend from approximately the inner surface of the left side wall to a depth just short of the face of the interior housing 181.

Accordingly, the top insertion slot 165*a* comprises a top surface defined by the inner surface of the top face 102 of the exercise device; and a bottom surface defined by the top surface of the upper shelf 153*a*. The middle insertion slot 165*b* comprises a top surface defined by the bottom surface of upper shelf; and a bottom surface defined by the top surface of the lower shelf. And the bottom insertion slot 165*c* comprises a top surface defined by the bottom surface of the lower shelf; and a bottom surface defined by the inner surface of the bottom surface of the device 103.

It will be appreciated that each of the insertion slots (165*a*, 165*b*, 165*c*) and each of the components that comprise the upper and lower shelves may be any shape and/or size required to receive and support a given weight. For example, FIG. 3C shows a middle insertion slot 165*b* sized to securely receive a given weight therein. The height, length and width of the insertion slot are each slightly larger than the corresponding property of the weight. Similarly, the overall shape of the insertion slot corresponds to the shape of the weight 170 (shown in FIG. 4). Moreover, each of the insertion slots may comprise the same or substantially similar shapes, or may vary in shape to receive different sized weights.

It will also be appreciated that the exercise device includes a left side and a right side that, except where otherwise described, are generally identical. Thus, when reference is made to one or more parts on the left side of the device, it is to be understood that corresponding or similar part(s) may be disposed on the right side of the device. Specifically, the right side may comprise an internal compartment 160 that is substantially identical to the internal compartment described above with reference to the left side of the device. Indeed, it is currently preferred to include both a left-side compartment and right-side compartment that are substantially similar. This allows a user to add or remove identical weights on both sides such that the device is symmetrically balanced.

Figure 4:
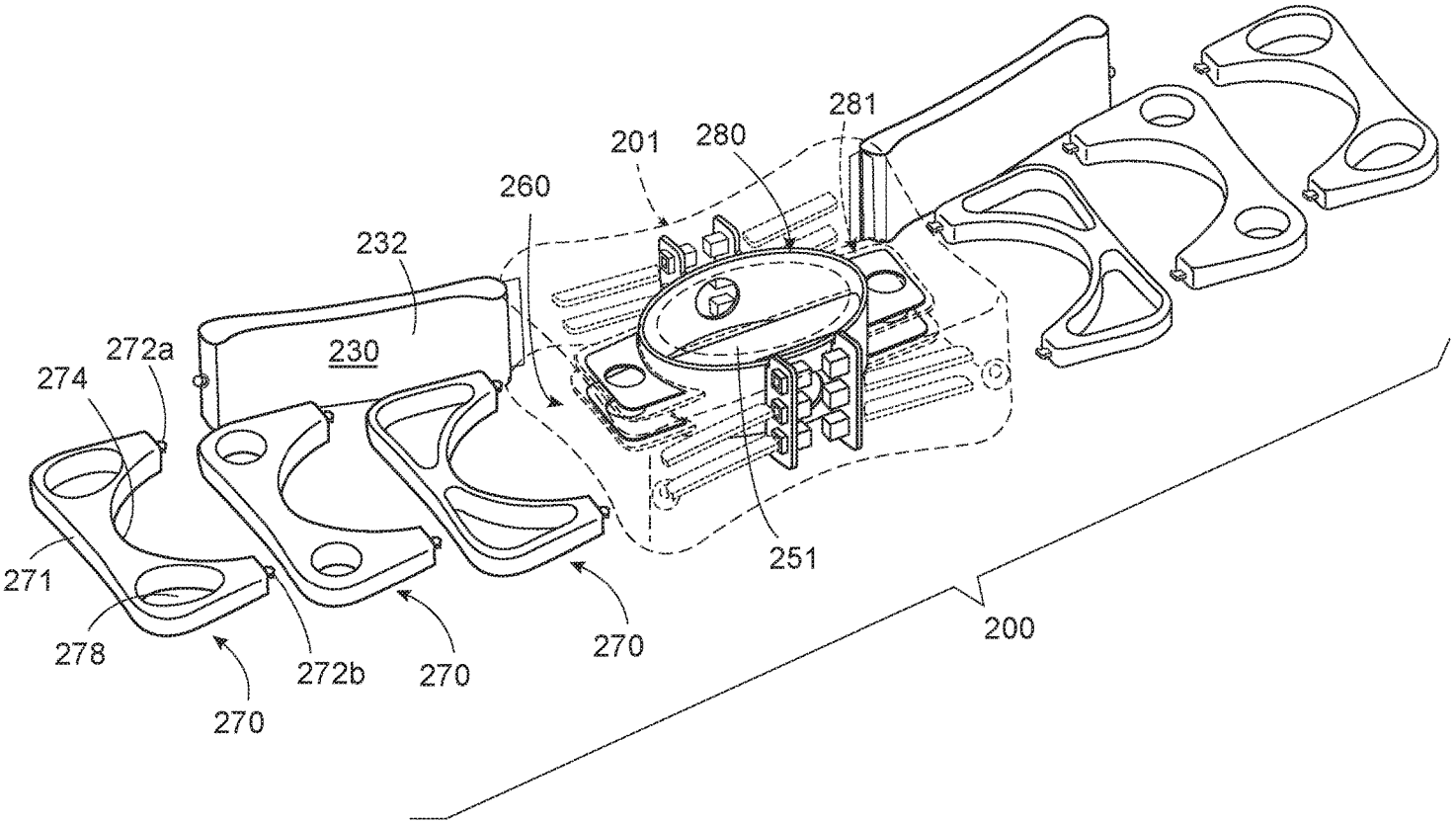
FIG. 4 is an exploded view of an adjustable-weight, handheld exercise device 200 according to an exemplary embodiment of the invention, where the outer body of the device 201 is transparent.

Referring to FIG. 4, an exploded view of an adjustable-weight, handheld exercise device 200 according to an exemplary embodiment of the invention is illustrated with the exterior walls of the device body 201 shown as being transparent. As shown, the device comprises one or two internal compartments 260 for removably receiving a number of weights 270 therein, each compartment accessible by opening a covering member 230 that covers a compartment opening when closed.

In one embodiment, the device may comprise an internal support structure 280 present within its interior volume and adapted to support the mass of the device, including any removable weights housed in the internal chambers thereof. The support structure 280 is shown to be further embedded within an interior housing 281 that extends inward from the top and bottom surfaces of the device to cover any and/or all components of the support structure except, in some embodiments, the handle 251. The interior housing 281 may comprise the same material as the body 201, and may be integrally formed therewith. The interior housing thus facilitates secure attachment of the support structure 280 to the interior of the device body.

Figure 5:
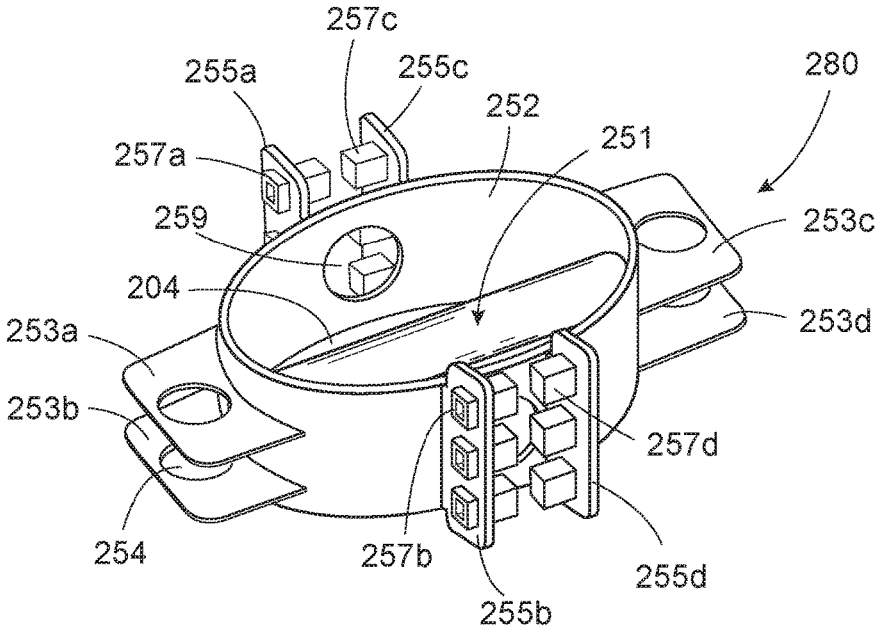
FIG. 5 is a top perspective view of an internal support structure 280 that may be embedded within an internal volume of an exercise device according an exemplary embodiment of the invention.

As shown in FIGS. 4 and 5, the support structure 280 is shown to comprise an oval-shaped support frame 252 defining a through-hole 204. A handle 251 is disposed within the through-hole, extending from an approximately central point on a left side of the frame to an approximately central point on a right side of the frame.

The handle 251 may be integrally formed with the frame 252, or may be attached thereto by any means known in the art. For example, the handle may be secured to the inner surface of the support structure via an adhesive material. As another example, the handle may be anchored to the inner support through the use of pins.

In one embodiment, the left and right walls of the support frame 252 include generally centrally-formed apertures for receiving end portions of the handle. Although not shown, such apertures may include attachment means for attaching the handle ends to the internal structure. For example, the left and right ends of the handle may comprise an attachment means that engage with complementary attachment means located about the left-side and right-side apertures within the frame. In one embodiment, the handle ends comprise a threading complementary to a threading provided within the apertures. In another embodiment, one or more of the apertures may include a keyway that receives a key from the end portion(s) of the handle (or vice versa).

The support structure frame 252 may comprise a number of horizontal brackets (253*a*, 253*b*) extending horizontally from at least a first outer surface of the frame. As discussed above in reference to FIG. 3B, one or more horizontal brackets (253*a*, 253*b*) may be approximately located on a left side of the outer surface of the frame 252, spaced a vertical distance apart. For example, a top bracket 253*a* may be located a vertical distance from the top surface of the frame, where the vertical distance is approximately equal to (or at least as large as) the height of a single weight. A bottom bracket 253*b* may be located a vertical distance from the bottom surface of the frame, and a vertical distance from the top bracket, where the vertical distance is approximately equal to (or at least as large as) the height of a single weight. This configuration allows the horizontal brackets to support a weight inserted into the inner compartment of the exercise device, as shown in FIG. 3C.

Moreover, it allows for up to three weights to be inserted into the device, where a top weight rests above the top bracket 253*a* and is supported by the top bracket; a middle weight rests between the top bracket and bottom bracket 253*b* and is supported by the bottom bracket; and a bottom weight rests below the bottom bracket when the exercise device is held with the topside-up relative to the ground. By positioning the brackets a vertical distance apart that is just slightly larger than the height of a weight, the brackets prevent vertical movement of any weights present in the exercise device.

Although two brackets (253*a*, 253*b*) are shown on the left side of the frame 252, it will be appreciated that any number of brackets may be included thereon, depending on the number of weights desired to be held within an internal compartment of the exercise device. For example, a device that allows for only two weights to be inserted into a single compartment may comprise a single horizontal bracket. As another example, a device that allows for four weights to be inserted into a single compartment may comprise three horizontal brackets.

Each horizontal bracket may comprise any shape, size and/or thickness required to support a given weight, as long as it: can be attached to the support frame, fits within the interior of the device body, meets any desired and/or required weight specifications and/or allows for one or more weights to be inserted and/or removed from the internal compartment. For example, a horizontal bracket (253*a*, 253*b*) may comprise a trapezoidal shape, with a curved right end attached to the frame 252; a substantially straight, shorter left end; and substantially straight sides. As another example, the horizontal bracket may comprise a rounded left end and/or rounded sides.

In the pictured embodiment, each of the horizontal brackets comprises an aperture 254 through the top and bottom surface thereof. Such aperture is not required, however this design provides for a lighter-weight device, which may be desirable. For the same reason, one or more optional apertures 259 may also be present in the frame 252.

The support structure frame 252 may also include a pair of vertical rack brackets, including a front vertical rack bracket 255*a* extending outward from approximately the front side of the frame and a rear vertical rack bracket 255*b* extending outward from approximately the back side of the frame. The first and second vertical rack brackets are substantially similar in size and shape, and each extends from approximately the bottom of the frame 252 to the top thereof.

Each of the vertical rack brackets may comprise a number of vertically spaced apertures each adapted to secure a fastener (257*a*, 257*b*) therein. Accordingly, each bracket (255*a*, 255*b*) may comprise a top fastener located a vertical distance from a middle fastener, which is in-turn located a vertical distance from a bottom fastener. The top fasteners, middle fasteners, and bottom fasteners of the first and second vertical rack brackets ("fastener pair") are located on substantially the same horizontal plane, respectively. For example, the top fastener 257*a* of the front vertical rack bracket 255*a* is on the substantially same horizontal plane as the top fastener 257*b* of the rear vertical rack bracket 255*b*.

Such fastener pairs are adapted to engage with complementary fastener pairs (272*a*, 272*b*) present on the weights 270 (discussed below). Accordingly, weights may be securely fastened to the support structure 280 via the vertical rack brackets (255*a*, 255*b*) to further prevent movement of the weight during device use.

In a preferred embodiment, the fasteners (257*a*, 257*b*) comprises female touch or push latches. However, any known fastening means may be employed, such as but not limited to a magnetic touch latch, a lever latch, a magnetic catch, a roller catch, a bales catch and/or a double ball catch. In an alternative embodiment, no fastening means may be employed.

The illustrated configuration allows for up to three weights to be inserted into the first internal chamber 260 of the device, where a top weight engages with a top fastener pair, a middle weight engages with a middle fastener pair, and a bottom weight engages with a bottom fastener pair. Although the vertical racks are shown to hold three vertically spaced fastener pairs, it will be appreciated that any number of fastener pairs may be included, depending on the number of weights desired to be held within an internal compartment of the exercise device.

The inner support structure 280, including each of the frame 252, horizontal bracket (253*a*, 253*b*) and vertical brackets (255*a*, 255*b*), may be constructed of any suitable material, such as but not limited to metal (e.g., aluminum, stainless steel, titanium), hard plastics, wood, nylon-glass reinforced material or the like. The structure 280 should be sufficiently strong to support the amount of weight desired, and to withstand repeated use during exercise. Moreover, the support structure material may be chosen to provide a lightweight device that is sufficiently light for use in activities that do not require weights, such as yoga poses and general stretching.

A preferred method of manufacture and preferred material for fabrication of the exercise device is injection molding from plastic and/or plastic foam. Injection molding allows for the device to be produced at a low unit cost in a variety of smooth or custom contours to suit the needs and preferences of practitioners. In one particular embodiment, overmolding of the inner support structure 280 may be employed to create an interior housing 281. Such overmolding may be followed by an injection of plastic and/or plastic foam about the interior housing 281 to form the device body 201.

It will be appreciated that the exercise device may include one or two internal compartments into which weights may be inserted and removed. Accordingly, the inner support structure frame 252 may comprise the above-described horizontal brackets and/or vertical rack brackets on a single side thereof (e.g., only a left side) or on both a left side and right side thereof. If two internal compartments are included, the horizontal and vertical brackets present within either internal compartment will be generally identical, except where otherwise described. Thus, when reference is made to one or more parts present within a left internal compartment, it is to be understood that corresponding or similar part(s) are disposed in a right internal compartment. For example, a device having two internal chambers may comprise an inner support structure frame 252 having an additional number of horizontal brackets (253*c*, 253*d*) on a right side thereof; and an additional pair of vertical rack brackets (255*c*, 255*d*) extending from a front and rear side thereof, where each vertical rack bracket in the right internal compartment comprises the same number of fasteners (257*c*, 257*d*) in the same configuration as those present within the left internal compartment.

Referring back to FIG. 4, the weights 270 are heavy plate-like members receivable in one or more insertion slots present within an internal compartment 260. As shown, each of the weights are shaped such that they may be received within the internal compartment(s) 260 of the exercise device, while allowing the door(s) 230 to be closed when weights are seated therein. Accordingly, each weight 270 comprises a straight or slightly concave left side 271, depending on the shape of the inner surface of the door.

The right side of the weights may comprise a substantially flat first portion 275*a* and a substantially flat second portion 275*b* separated by a concave middle portion or channel 274. In certain embodiments, the channel 274 engages with a curved left surface of an interior housing 281 that encloses the internal support structure 280. The concave right side 274 allows the weight to securely receive the outer surface of the frame 252 of the internal support structure 280 therewithin, such that the weight may only move in a front/back direction incidentally through friction.

The substantially flat first portion 275*a* and second portion 275*b* on the right side of each weight 270 may each include a fastener (272*a*, 272*b*) partially disposed within an aperture located on the respective portion. Such fasteners are adapted to engage with the complementary fasteners present on the pair of vertical rack brackets disposed within the interior of the device body (see FIG. 5 at 257*a*, 257*b*). Fastening the weight to the support structure further prevents movement of the weight during device use, for example in a right/left direction.

In a preferred embodiment, the fasteners (272*a*, 272*b*) comprises male touch or push latches. However, any known fastening means may be employed, such as but not limited to a magnetic touch latch, a lever latch, a magnetic catch, a roller catch, a bales catch and/or a double ball catch. In an alternative embodiment, no fastening means may be employed.

Generally, the weights 270 may comprise a substantially flat top and bottom surface, and a height that is substantially less than both its length and width. The height, length and width of the weight should be selected such that it fits securely within any of the insertion slots within an internal compartment 260 and may also be inserted and/or removed by a user with ease.

In one embodiment, the weight may comprise a height of about 0.5 inches; a width of from about 2.5 inches to about 4 inches; and a length of from about 6 inches to about 8 inches. In one embodiment, the channel 274 may extend inward about 3 inches from the right side of the weight.

In certain embodiments, the weights 270 may comprise a rubberized and/or colored coating. In certain embodiments, the weights may be color coded such that all weights having a particular color contain the same mass.

The weights 270 may also comprise one or more apertures 278 extending through a top and bottom surface thereof. The size and/or shape of such apertures may allow for substantially similarly shaped weights to have differing mass. For example, a weight with a large aperture 278 will have less mass than a substantially similarly sized weight with a smaller aperture. Moreover, the shape of the aperture 278 may provide a visual indication to a user of that weight's mass. For example, all weights with small circular apertures may be 0.5 pounds; all weights with slightly larger oval-shaped apertures may be 1 pound; and all weights with larger triangular-shaped apertures may be 1.5 pounds. It will be appreciated that the pictured and above-described embodiments are merely exemplary and any number of apertures having any shapes and/or sizes may be employed.

Although the illustrated embodiment shows three weights 270 being added per internal compartment 260, it will be understood that any number of weights can be employed in a single compartment, so long as the size of the exercise device 200 is acceptable to a user.

According to one embodiment, a user wishing to use the exercise device will first determine an amount of weight to be lifted. The user will then open a covering member covering a first internal compartment to expose a number of insertion slots located therein. The user may then add weight to first internal compartment by inserting the weight into an available insertion slot until it engages with one or more fasteners located within the compartment. The covering member is then closed. This process is typically repeated for a second internal compartment located on an opposite side of the exercise device. At this point, the device is ready for use and may be lifted or otherwise engaged by the user.

The user may remove a weight in similar fashion. For example, the user first opens the covering member of the first internal compartment. The user may then remove a weight by, for example, pushing it inward, thereby disengaging it from the fastening mechanism. Once the weight is disengaged, it may be easily removed by pulling it in an outward direction. The covering member is then closed. And this process is typically repeated for a second internal compartment located on an opposite side of the exercise as to allow the device to be balanced. Again, at this point, the device is ready for use and may be lifted or otherwise engaged by the user.

In the foregoing detailed description, reference is made to the accompanying drawings which form a part of hereof, and in which is shown by way of illustrations of specific embodiments from which the invention may be practiced. In this regard, directional terminology, such as "vertical," "horizontal," "top," "bottom," "front," "back," "left," "right," etc., is used with reference to the orientation of the Figure(s) being described. Because components of the embodiments of the present invention can be positioned in a number of different orientations, the directional terminology is used for purposes of illustration and is in no way limiting. It is to be understood that other embodiments may be utilized and structural or logical changes may be made without departing from the scope of the present invention. The foregoing detailed description, therefore, is not to be taken in a limiting sense, and the scope of the present invention is defined by the appended claims.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

I claim:

1. A weight-adjustable, handheld exercise device comprising:

a body comprising:

a top wall connected to a substantially parallel bottom wall via a peripheral wall comprising:

substantially parallel front and back side walls;

a right side wall; and a left side wall substantially parallel to the right side wall and comprising an aperture extending from an outer surface to an inner surface of the left side wall;

a central through-hole extending from the top wall to the bottom wall;

a first internal compartment extending within an internal volume of the body from the inner surface of the left side wall, the first internal compartment adapted to removably receive one or more weights therein, wherein the first internal compartment further comprises a first insertion slot adapted to removably receive a first weight of the one or more weights therein; and a handle disposed within the central through-hole and adapted to be gripped by a user.

2. An exercise device according to claim 1, wherein:

the first insertion slot comprises one or more fasteners adapted to receive one or more complementary fasteners located on the first weight, such that the first weight may be fastened within the first insertion slot.

3. An exercise device according to claim 1, wherein the first internal compartment further comprises a second insertion slot adapted to removably receive a second weight of the one or more weights therein.

4. An exercise device according to claim 3, wherein the first insertion slot is separated from the second insertion slot by a first shelf present within the first internal compartment.

5. An exercise device according to claim 4, wherein the first shelf comprises a first horizontal bracket extending from a support structure located within the interior volume of the body, toward the left side wall.

6. An exercise device according to claim 4, wherein the first shelf comprises:

a first front side rail extending horizontally along an inner surface of the front side wall of the body, within the first internal compartment; and a first back side rail extending along an inner surface of the back side wall of the body, within the first internal compartment.

7. An exercise device according to claim 6, wherein the first shelf further comprises a first horizontal bracket extending from a support structure located within the interior volume of the body, toward the left side wall.

8. An exercise device according to claim 7, wherein the first insertion slot and second insertion slot each comprise one or more fasteners adapted to receive one or more complementary fasteners located on the first or second weights, such that the first or second weights may be fastened within the first insertion slot.

9. An exercise device according to claim 8, wherein the one or more fasteners of the first insertion slot and second insertion slot are fixed to at least one vertical rack bracket fixed to the support structure.

10. An exercise device according to claim 3, wherein the first internal compartment further comprises a third insertion slot adapted to removably receive a third weight of the one or more weights therein.

11. An exercise device according to claim 10, wherein:

the first insertion slot is separated from the second insertion slot by a first shelf present within the first internal compartment; and the second insertion slot is separated from the third insertion slot by a second shelf present within the first internal compartment.

12. An exercise device according to claim 11, wherein:

the first shelf comprises:

a first front side rail extending horizontally along an inner surface of the front side wall of the body, within the first internal compartment;

a first back side rail extending along an inner surface of the back side wall of the body, within the first internal compartment; and a first horizontal bracket extending from a support structure located within the interior volume of the body, toward the left side wall; and the second shelf comprises:

a second front side rail extending horizontally along the inner surface of the front side wall of the body, within the first internal compartment;

a second back side rail extending along the inner surface of the back side wall of the body, within the first internal compartment; and a second horizontal bracket extending from the support structure toward the left side wall.

13. An exercise device according to claim 12, wherein the first insertion slot, second insertion slot and third insertion slot each comprise one or more fasteners adapted to receive one or more complementary fasteners located on the first or second weights, such that the first or second weights may be fastened within the first insertion slot.

14. An exercise device according to claim 13, wherein the one or more fasteners of the first insertion slot and second insertion slot are fixed to at least one vertical rack bracket fixed to the support structure.

15. An exercise device according to claim 1, wherein:

the right side wall further comprises an aperture extending from an outer surface to an inner surface of the right side wall;

the body further comprises a second internal compartment extending within an internal volume of the body from the inner surface of the right side wall, the second internal compartment adapted to removably receive a second weight of the one or more weights therein; and the device further comprises a right side covering member fastened to the body, the right side covering member adapted to cover the right side wall aperture when placed in a closed state, and to allow access to the right side wall aperture when placed in an open state.

16. An exercise device according to claim 15, wherein the second internal compartment comprises a second insertion slot adapted to receive the second weight.

17. An exercise device according to claim 15, further comprising:

the first weight seated within the first insertion slot located within the first internal compartment;

the second weight seated within the second insertion slot located within the second internal compartment.

18. An exercise device according to claim 1, further comprising a left side covering member fastened to the body, the left side covering member adapted to cover the left side wall aperture when placed in a closed state, and to allow access to the left side wall aperture when placed in an open state.

19. A weight-adjustable, handheld exercise device comprising:

a top wall connected to a substantially parallel bottom wall via a peripheral wall comprising:

substantially parallel front and back side walls;

a right side wall comprising an aperture extending from an outer surface to an inner surface of the right side wall; and a left side wall substantially parallel to the right side wall and comprising an aperture extending from an outer surface to an inner surface of the left side wall, a central through-hole extending from the top wall to the bottom wall, an inner support structure extending around the central through-hole, from an inner surface of the top wall to an inner surface of the bottom wall;

a handle disposed within the central through-hole and fixed to the inner support structure;

a first internal compartment extending within an internal volume of the body from the inner surface of the left side wall to the inner support structure, the first internal compartment comprising a number of insertion slots, each adapted to removably receive a first weight therein;

a second internal compartment extending within the internal volume of the body from the inner surface of the right side wall to the inner support structure, the second internal compartment comprising a number of insertion slots, each adapted to removably receive the first weight or a second weight therein;

a left side covering member fastened to the body, the left side covering member adapted to cover the left side wall aperture when placed in a closed state, and to allow access to the left side wall aperture when placed in an open state; and a right side covering member fastened to the body, the right side covering member adapted to cover the right side wall aperture when placed in a closed state, and to allow access to the right side wall aperture when placed in an open state.

* * * * *